United States Patent [19]

Vidovic et al.

[11] Patent Number: 4,967,684

[45] Date of Patent: Nov. 6, 1990

[54] WARNING DEVICE

[75] Inventors: Ninoslav Vidovic; Aleksandra Vidovic, both of 5032 Centre Ave., Apt. 201, Pittsburgh, Pa. 15213; Arnold J. Cook, 5508 Baywood St., Pittsburgh, Pa. 15206

[73] Assignees: Ninoslav Vidovic; Aleksandra Vidovic; Arnold J. Cook, all of Pittsburgh, Pa.

[21] Appl. No.: 252,780

[22] Filed: Oct. 3, 1988

[51] Int. Cl.[5] ..... G10K 9/04; A63C 11/22

[52] U.S. Cl. ..... 116/142 FP; 116/137 R; 116/DIG. 44; 181/179; 181/190; 280/816; 280/821; 381/156; 74/551.9

[58] Field of Search ..... 116/3, 24, 59, 137 R, 116/142 R, 142 FP, DIG. 44; 135/65, 66, 72, 76; 280/816, 819, 821, 822; 446/216; 362/102; 222/3, 5, 39; 124/55; 181/178, 179, 189, 190; 381/156; 74/551.8, 551.9; 16/DIG. 12

[56] References Cited

U.S. PATENT DOCUMENTS

| | | | |
|---|---|---|---|
| 2,840,032 | 6/1958 | Reeves | 116/137 R |
| 4,023,817 | 5/1977 | Lah et al. | 280/821 |
| 4,044,712 | 8/1977 | Goodman et al. | 116/142 FP |
| 4,206,445 | 6/1980 | Steinhauer | 340/321 |
| 4,278,274 | 7/1981 | Ray | 280/821 |
| 4,645,235 | 2/1987 | Joseph | 280/821 |

FOREIGN PATENT DOCUMENTS

| | | | |
|---|---|---|---|
| 2012872 | 10/1971 | Fed. Rep. of Germany | 280/816 |
| 2209707 | 9/1973 | Fed. Rep. of Germany | 280/816 |
| 2223055 | 10/1973 | France | 280/816 |
| 2503571 | 10/1982 | France | 280/821 |
| 628738 | 11/1961 | Italy | 116/137 |

*Primary Examiner*—William A. Cuchlinski, Jr.
*Assistant Examiner*—W. Morris Worth
*Attorney, Agent, or Firm*—Alder, Cohen & Grigsby

[57] ABSTRACT

The present invention pertains to a warning apparatus with respect to a ski-pole. The warning apparatus is comprised of a device for signaling that does not require the ski-pole to be seen in order for a signal provided by the signaling device to be noticed. The signaling device is in juxtaposition with the ski-pole. Additionally, the warning apparatus is comprised of a device for activating the signaling device. The activating device is in communication with the signaling device. In a preferred embodiment, the activating device includes a device for powering the signaling device and a device for actuating the powering device so the signaling device receives power to produce a signal. In a more preferred embodiment, the warning apparatus is comprised of a modular grip that is comprised of a first element having a first opening that receives the end of the ski-pole, a platform at the top of the first element, a hand conforming area disposed essentially parallel to the first opening, and a second opening disposed essentially parallel to the first opening and disposed in the first element essentially opposite the hand conforming area. The modular grip is also comprised of a second element having the device for signaling and the device for actuating the signaling means. The second element is removably attached to the platform. Additionally, the modular grip is comprised of a third element having the device for powering the signaling device. The powering device is controlled by the actuating device to power the signaling device. The third element is removably attached to the second opening of the element.

6 Claims, 4 Drawing Sheets

WARNING DEVICE

FIELD OF THE INVENTION

The present invention pertains to a warning apparatus with respect to a ski-pole. More specifically, the present invention pertains to a warning apparatus comprised of a modular grip from which a signal is provided that alerts people nearby that the skier is present.

BACKGROUND OF THE INVENTION

Skiing has become a very popular sport attracting huge number of skiers to ski areas every year. There are a number of situations while skiing which cause the threat of accidental injury due to, for instance, collisions between skiers, or frostbite and freezing due to a skier becoming lost under severe weather conditions.

There are a number of situations on the ski slopes which might lead to collisions between skiers. The most common cause for collisions is when the speed of the skier is not adjusted according to the skiing conditions of the slopes or to the level of the skiing skill of the skier. Skiing with high speed on crowded, icy slopes or under reduced visibility as well as skiing on a slope which does not correspond to the skiing abilities of the skier might cause the skier to lose control and collide with other skiers. A common situation is when a slower skier is overtaken by a faster skier and the slower skier turns into the path of the faster skier resulting in a collision and injuries.

Under the conditions of reduced visibility caused by fog or falling snow, a skier can wander from a marked ski trail. There are reported cases of skiers freezing to death in situations where skiers missed marked ski slopes by the length of a ski and subsequently became lost in the mountain adjoining the slope.

Another situation is where a part of a ski slope is closed for special events, such as ski races, or a ski slope is completely shutdown because of dangerous conditions thereon and thus do not require attendance of ski patrols. Skiers go down these slopes, and fall experiencing an injury thereupon. If no one is around to find them, the results can be deadly.

It is therefore desirable that some easy, convenient means be available for warning skiers in potentially dangerous situations or conditions on ski slopes, or signaling in the case of the dangerous weather conditions such as reduced visibility.

In U.S. Pat. No. 4,206,445 it is proposed a light source be accommodated in the handle of a ski-stick which emits visible warning signals using electric power. Use of the device is limited to the situations when a skier wants to show directions of his turn.

In U.S. Pat. No. 4,278,274 there is proposed a warning device producing an audible sonic signal using electrical power and a battery as source of energy. Major limitations of electrically powered devices for this purpose are the significant reduction of the life time of the battery under the conditions of the lower temperatures and insufficient loudness which can be obtained from standard sized battery powered speaker devices.

Horns/whistles operated by pressurized gas have two main advantages over electrically powered devices: loudness and insensitivity to the operational conditions, particularly low temperatures.

Loudness of the sound blasts generated by compressed gas powered horns makes these devices ideal for the outdoor conditions such as large open spaces, trees, fog and snowing. Also loudness and the number of sound blasts are not affected by operational conditions like low temperatures.

The general object of the invention is to provide a device which is easily accommodated on a ski pole and used as a ski pole handle and warning signaling device.

Another object of the invention to provide a device which emits an audible warning signal.

Still another object of the invention is to provide a ski pole handle which contains a warning-signaling device and which is easily and quickly installed or replaced as needed.

Other objects of the invention and a number of the advantages thereof will be apparent from the accompanying drawings and description of the invention.

SUMMARY OF THE INVENTION

The present invention pertains to a warning apparatus with respect to a ski-pole. The warning apparatus is comprised of means for signaling that does not require the ski-pole to be seen in order for a signal provided by the signaling means to be noticed. The signaling means is in juxtaposition with the ski-pole. Additionally, the warning apparatus is comprised of means for activating the signaling means. The activating means is in communication with the signaling means.

In a preferred embodiment, the activating means includes means for powering the signaling means and means for actuating the powering means so the signaling means receives power to produce a signal.

In a more preferred embodiment, the warning apparatus is comprised of a modular grip that is comprised of a first element having a first opening that receives the end of the ski-pole, a platform at the top of the first element, a hand conforming area disposed essentially parallel to the first opening, and a second opening disposed essentially parallel to the first opening and disposed in the first element essentially opposite the hand conforming area. The modular grip is also comprised of a second element having means for signaling and means for actuating the signaling means. The second element is removably attached to the platform. Additionally, the modular grip is comprised of a third element having means for powering the signaling means. The powering means is controlled by the actuating means to power the signaling means. The third element is removably attached to the second opening of the element.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
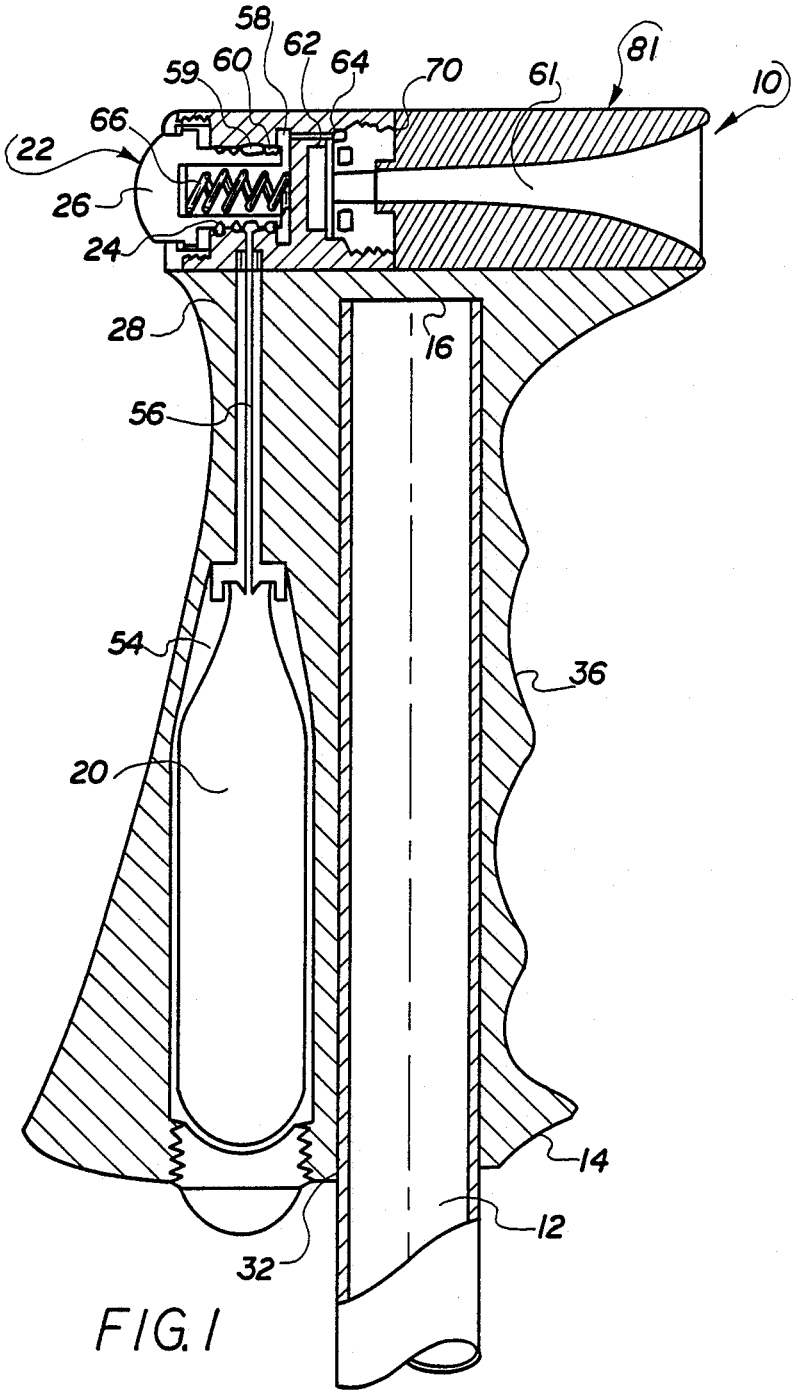
FIG. 1 is a schematic cross-sectional view of the warning device.

Referring now to drawings where like-reference numerals refer to identical or corresponding parts throughout the several views and more specifically to FIG. 1 thereof, there is shown a warning apparatus 10 with respect to a ski-pole 12. The warning apparatus comprises means for signaling that does not require the ski-pole 12 to be seen in order for a signal provided by the signaling means to be noticed. The signaling means is in juxtaposition with the ski-pole 12. The warning apparatus 10 is also comprised of means for activating the signaling means. The activating means is in communication with the signaling means. Preferably, the activating means and the signaling means are in contact with the ski-pole 12. In a preferred embodiment, the activating and the signaling means are part of a grip.

Figure 3:
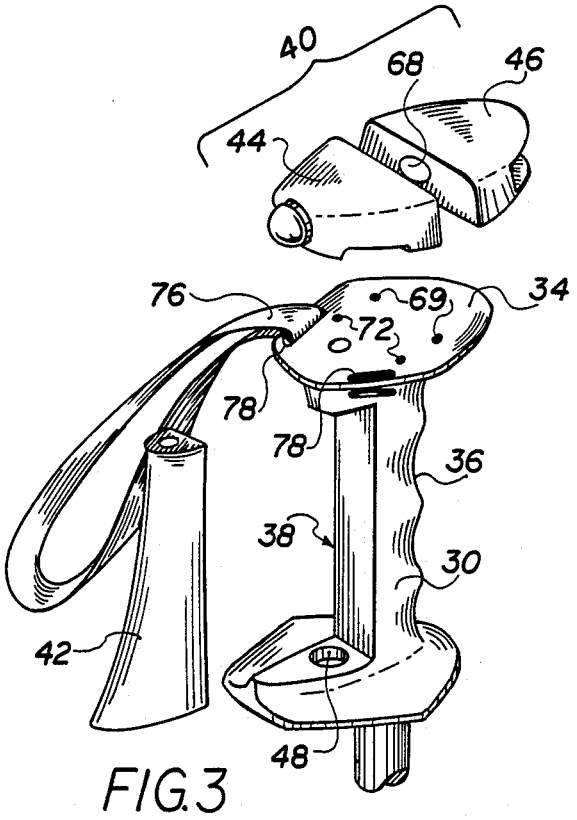
FIG. 3 is a exploded view of the warning device.

Preferably, the activating means includes means for powering the signaling means and means for actuating the powering means so the signaling means receives power to produce a signal. Additionally, the grip 14 is modular as shown in FIG. 3. The modular grip 14 is comprised of a first element 30 having a first opening 32 that receives the top 16 of the ski-pole 12, a platform 34 at the top of the first element 30 and a hand conforming area 36 essentially parallel to the first opening 32. Additionally, a first element 30 includes a second opening 38 disposed essentially parallel to the first opening 32 and disposed in the first element 30 essentially opposite the hand conforming area 36.

Figure 4:
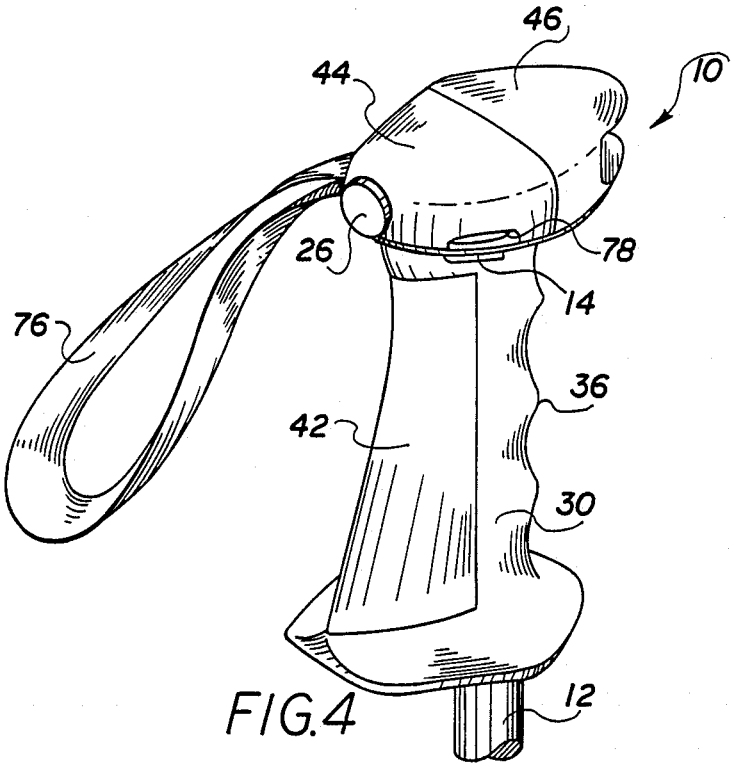
FIG. 4 is an angular view of the warning device.

The modular grip 14 also is comprised of a second element 40 that has the signaling means and the means for actuating the signaling means. The second element 40 is removably attached to the platform 34. Moreover, the modular grip 14 has a third element 42 having the means for powering the signaling means. The powering means is controlled by the actuating means to power the signaling means. The third element 42 is removably attached to the first element 30 through the second opening 38 thereof. Preferably, the second element 40 has a first part 44 and a second part 46 which are each removably attachable to the platform 34 and in contact when disposed thereon. The actuating means is disposed in the first part 44 of the second element 40. The modular grip is shown in FIG. 4 in its assembled form.

The signaling means is, for instance, a whistle, a siren, or preferably a horn 81 that produces an acoustic signal. The signaling means, however, can also be a light emitting device such as a strobe light or a transmitter or transmitter-receiving device (not shown).

The powering means is, for instance, a battery or preferably a pressurized gas cartridge 20. The gas cartridge 20 is fluidically connected to the horn 81. The activating means controls when gas from the cartridge 20 passes to the horn 81 to power the horn 81.

The activating means can be an electrical circuit that, for instance, allows current to be provided, to an electrically powered device such as a light emitting device (not shown) or preferably a valve 22 when a gas cartridge 20 is used to power a horn 18. The valve 22 preferably has a first portion 24 controlling when gas from the cartridge 20 passes to the horn 81. The valve 22 also has a second portion 26 which is connected to the first portion 24 and which extends from the surface 28 of the grip 14 such that when the second portion 26 is pushed toward the grip 14, the first portion 24 allows gas to pass therethrough.

Figure 2:
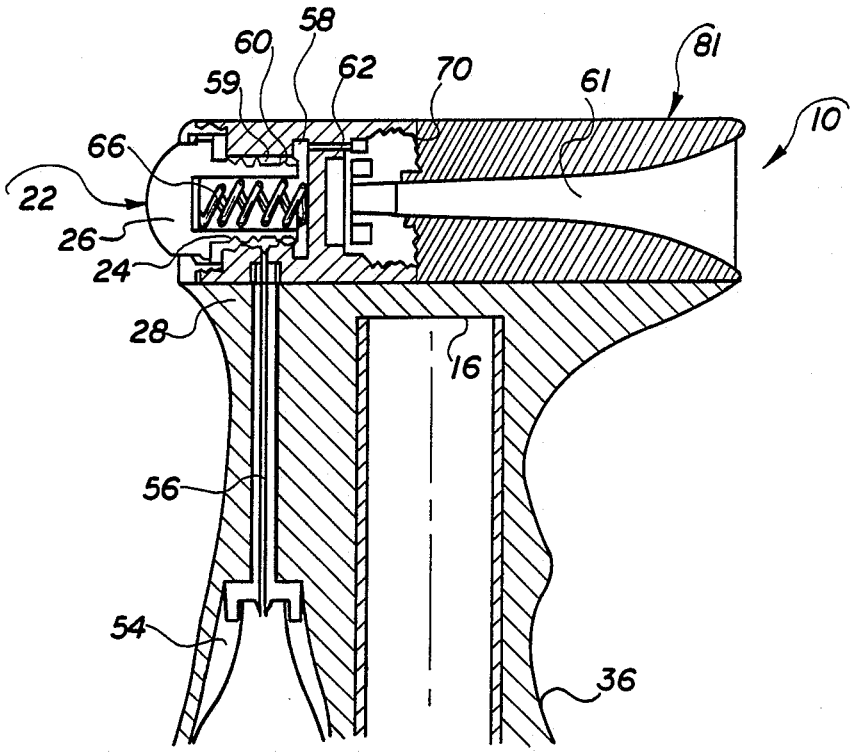
FIG. 2 is a schematic cross-sectional view of a portion of the warning device.

In the operation of the preferred embodiment, and referring to FIGS. 2 and 3, a cartridge 20 is inserted into the third element 42. As the cartridge 20 is seated into an opening 54 in the third element 42, a hollow rod 56 penetrates into the cartridge 20 allowing the pressurized gas to escape into the rod 56. The pressurized gas in the hollow rod 56 is contained by the first portion 24 of the valve 22 in a first channel 59 that is formed in the first portion 24 of the valve 22.

When the second portion 26 of the valve 22 is depressed by a user, the first portion 24 of the valve 22 is forced to move toward the second channel 58. When this occurs, O-rings 60, which aid in the retention of the pressurized gas in the first channel 59, move into the second channel 58. When the O-rings 60 enter into the second channel 58, the pressurized gas is able to escape into the second channel 58.

From the second channel 58, the pressurized gas passes through third channel 62 to diaphragm 64 which is caused to vibrate by the pressurized gas. The vibration of the diaphragm 64 causes an acoustic signal to be produced that can be heard by people in the vicinity of the user. The signal produced by the diaphragm 64 passes out of the grip 14 via a resonance chamber 61 of the horn 81.

When the user releases the second portion 26 of the valve 22, a spring 66 causes the first portion 24 and second portion 26 of the valve to return to the original position. Pressurized gas is then again contained by the first portion 24 of the valve 26. In this way, the pressurized gas in the cartridge 20 is conserved and the user can produce many signals with the warning device 10 before the gas in the cartridge 20 is exhausted.

If, for instance, a user desires to change the pitch of the signal produced by the horn 81 then the second part 46 of the second element 40 can be removed and a different second part 46 with a differently shaped resonance chamber 61 can be attached to the platform 34. This can be accomplished, for instance, by inserting plugs (not shown) on the bottom of the second element 46 into the second part plug holes 69 in the platform 34 and also aligning the opening 68 of the horn 81 in the second element 40, as shown in FIG. 3, with the opening 70 of the horn 81 in the first element 44, as shown in FIG. 1. Alternatively, the horn 81 of the second part 46 can have a male portion (not shown) that fits into a female portion (not shown) of first part 44 to maximize the passage of the signal produced by the diaphragm 64 of the horn 81.

Similarly, first part 44 of second element 40 can be replaced in a similar fashion as described with the replacement of the second part 46. In this instance, plugs (not shown) are fitted into first part plug holes 72 to replaceably attach the first part 44 with the platform,34.

The third element 42 can be replaced by first removing the cartridge 20 and then pulling the third element 42 away from the first element 30. The third element can then be releasably attached to the first element 30 by snapping the third element 42 into the second opening 38 of the first element 30. As this is done, hollow rod 56 is threaded into the first part 44 of the second element 40.

The grip 14 can be used for either the right hand or the left hand of a skier. Depending on which hand the pole is to be used with, a strap 76 can be placed in the appropriate strap hole 78 of which there is one either side of the rear portion of the platform 34.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A warning device with respect to a ski-pole comprising:

a modular grip comprising a first element having a first opening that receives the top of the ski-pole, a platform at the top of the first element, a hand conforming area disposed essentially parallel to the first opening, and a second opening disposed essentially parallel to the first opening and disposed in the first element essentially opposite the hand conforming area;

a second element having means for signaling and means for actuating the signaling means, said second element removably attached to the platform;

and a third element having means for powering the signaling means, said powering means being controlled by the actuating means to power the signaling means, said third element removably attached to the first element through the second opening thereof.

2. An apparatus as described in claim 1 wherein the second element has a first part and a second part which are each removably attachable to the platform and in contact when disposed thereon, said actuating means disposed in said first part.

3. An apparatus as described in claim 2 wherein the signaling means produces an acoustic signal.

4. An apparatus as described in claim 3 wherein the signaling means is a horn.

5. An apparatus as described in claim 4 wherein the powering means includes a gas cartridge having a pressurized gas which is fluidically connected to the horn, said actuating means controlling when gas from the cartridge passes to the horn to power the horn.

6. An apparatus as described in claim 5 wherein the actuating means includes a valve having a first portion controlling when gas from the cartridge passes to the horn, and a second portion which is connected to the first portion and which extends from the grip such that when the second portion is pushed toward the grip, the first portion allows gas to pass therethrough.

* * * * *